US011691772B2

(12) United States Patent
Hargreaves

(10) Patent No.: US 11,691,772 B2
(45) Date of Patent: Jul. 4, 2023

(54) PAPER CONTAINER TOP FLANGE

(71) Applicant: Proseal UK Limited, Adlington (GB)

(72) Inventor: Robert Julian Hargreaves, Cheshire (GB)

(73) Assignee: Proseal UK Limited, Adlington (GB)

( * ) Notice: Subject to any disclaimer, the term of this patent is extended or adjusted under 35 U.S.C. 154(b) by 160 days.

(21) Appl. No.: 16/544,526

(22) Filed: Aug. 19, 2019

(65) Prior Publication Data

US 2021/0053712 A1 Feb. 25, 2021

(51) Int. Cl.
*B65B 47/04* (2006.01)
*B65B 7/28* (2006.01)

(52) U.S. Cl.
CPC ..... *B65B 47/04* (2013.01); *B65B 7/2878* (2013.01)

(58) Field of Classification Search
CPC ..... B65B 67/2878; B65B 47/04
USPC ..... 53/478
See application file for complete search history.

(56) References Cited

U.S. PATENT DOCUMENTS 3,118,351 A * 1/1964 Meyer-Jagenberg .... B65D 3/12 493/109
3,491,509 A * 1/1970 Wright ..... B65B 7/2878 53/478
4,121,404 A * 10/1978 Davis ..... B65B 7/165 53/344
4,282,699 A * 8/1981 Embro, Jr. ..... B65B 7/164 53/367
4,569,474 A 2/1986 Buschor et al.
4,599,123 A * 7/1986 Christensson .... B29C 66/81419 156/69
5,155,974 A * 10/1992 Garwood ..... B65D 81/2076 426/396
5,226,531 A * 7/1993 Garwood ..... B65B 31/021 53/433
5,323,590 A * 6/1994 Garwood ..... B65B 11/52 53/433
5,534,282 A * 7/1996 Garwood ..... B65B 31/028 426/396
5,943,844 A * 8/1999 Wilhelm ..... B29C 65/7451 53/442

(Continued)

FOREIGN PATENT DOCUMENTS

EP 2 374 730 A1 10/2011
GB 2574057 A 11/2019

OTHER PUBLICATIONS

Extended European Search Report mailed Jan. 12, 2021, issued in European Patent Application No. 20 275 129.3 Hied Aug. 4, 2020, 7 pages.

*Primary Examiner* — Robert F Long
*Assistant Examiner* — Xavier A Madison
(74) *Attorney, Agent, or Firm* — Christensen O'Connor Johnson Kindness PLLC

(57) ABSTRACT

A plurality of camming surfaces (116) are actuated to move against the top portion of the side walls (38) of a container (36) to turn such top portion in an outward direction relative to the interior of the container sufficiently to enable the seal profile (90) of the top tool assembly (30) of a sealing apparatus (22) to press the outwardly disposed side wall top portions downwardly against an abutment formed by a bottom tool assembly (32) so as to create a horizontal, outwardly disposed sealing flange (40) to which a top film (34) is applied for closure of the container.

20 Claims, 9 Drawing Sheets

(56) References Cited

U.S. PATENT DOCUMENTS

| | | | | |
|---|---|---|---|---|
| 7,665,281 | B2 * | 2/2010 | Send | B29C 65/58 53/329.2 |
| 9,895,737 | B2 * | 2/2018 | Gaunter | B21D 51/10 |
| 9,902,509 | B2 * | 2/2018 | Schiavina | B29C 65/7451 |
| 10,183,766 | B2 * | 1/2019 | Hinze | B65B 7/2857 |
| 2007/0138192 | A1 * | 6/2007 | Send | B29C 66/8322 220/780 |
| 2012/0036815 | A1 * | 2/2012 | Holzem | B65D 1/26 53/488 |
| 2019/0217976 | A1 | 7/2019 | Paton | |

* cited by examiner

PAPER CONTAINER TOP FLANGE

BACKGROUND

Folded board (paper) trays or cartons are a preferred container for many food items, for example, fresh fruits including berries. The open tops of the trays/cartons are heat sealed with a transparent film. To this end, horizontal flanges extend along the top edges of the cartons to which the film is sealed. Such sealing occurs in automated machines that are designed for high-throughput, for example, up to 200 cartons per minute.

Typically, the pliable side walls of the folded board trays are pre-scored along their upper margin at the "flange fold" to enable the upper margin to be folded into a horizontal, outward position thereby forming the top flange.

However, often when the board trays/cartons are supplied by the manufacturer, the side walls are essentially vertical. As a consequence, when a film heat sealing head, having a flat contact surface, presses against the top edge of the tray/carton, if the side wall is vertical or close to vertical, an outwardly directed seal flange may not be correctly formed. Instead, the side wall, being pliable, may be crushed or may fold inwardly. As a consequence, a proper seal is not achieved between the film and the tray/carton. To help ensure that a proper sealing flange is formed, the flanges may have to be pre-broken by hand, or some other method used, which is time consuming as well as expensive.

The present application disclosure seeks to address the foregoing issue by providing a tool integrated into the heat sealing apparatus to "break" or otherwise fold the flanges outwardly so that an acceptable sealing flange can be created. As such, a top film can be heat sealed to the container, without causing damage to the container flange and also so that the container need not be pre-broken prior to applying the top film.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, an apparatus is provided for assisting in forming seal flanges along the top portion of the pliable side walls of a carton. The system includes a plurality of camming surfaces positioned to engage the top portion of the side walls of the carton an actuator to move the camming surfaces against the top portion of the side walls of the carton in an outward direction relative to the interior of the carton to force the top portion outwardly relative to the interior of the carton.

The carton has a bottom and the actuator moves the camming surfaces towards the bottom of the carton to bear against the top portion of the side walls of the carton.

In the apparatus the camming surfaces are contoured to extend upwardly and outwardly relative to the upper edge portions of the carton side walls thereby to force the upper edge portions outwardly as the camming surfaces are moved toward the bottom of the carton.

In the apparatus the camming surfaces are part of a linear cam.

In the apparatus the actuator is powered by a sealing assembly functioning to seal the carton.

In the apparatus the sealing assembly comprises a seal profile for sealing a film to the formed seal flanges of the carton.

In the apparatus further comprising a holder for receiving the carton therein, the holder comprising a perimeter extending along the upper portion of the carton.

In the apparatus the holder perimeter extends along the exterior of the upper portion of the carton side walls.

In the apparatus the perimeter surrounds an upper portion of the carton side walls.

In the apparatus the perimeter comprises a ledge extending around the exterior of the upper portions of the side wall.

In the apparatus the ledge comprises a horizontal abutment surface for abutting against the formed seal flanges.

In the apparatus the holder comprises a base for supporting the bottom of the carton during the operation of the camming surfaces.

In accordance with another embodiment of the present disclosure, a tray sealer is provided. The tray sealer includes a bottom tool assembly for receiving trays to be sealed, the trays having upwardly extending, pliable side walls. The tray sealer also includes a top tool assembly, comprising a camming structure for forcing the top margins of the tray side walls outwardly relative to the trays to initiate the formation of a sealing flange, the camming structure having a plurality of camming surfaces. The tray sealer further includes an actuator for moving the camming structure relative to the base tool assembly to press the camming surfaces against the top margins of the tray side walls to force the top margins of the side walls outwardly relative to the side walls.

In the tray sealer the camming structure comprises a plurality of camming surfaces contoured to press in unison against the top margins of the tray side walls as the camming structure is actuated by the actuator.

In the tray sealer the camming surfaces project outwardly relative to the tray in the direction along the tray side walls from the bottom of the tray to the top of the tray.

In the tray sealer the camming structure comprises a camming plate and wherein the camming surfaces projecting from the camming plate.

In the tray sealer the camming plate is in the form of a perimeter structure having an open central portion to provide clearance for portions of the top tool assembly.

In the tray sealer the camming surfaces project from the perimeter structure.

In the tray sealer the camming surfaces are disposed at the distal ends of wedge elements that project from the camming plate.

In the tray sealer the actuator causes the camming plate to move the camming structure toward the bottom tray assembly as the camming surfaces engage against the tray side walls.

In the tray sealer the actuator acts on at least one of the base tool assembly and the top tool assembly to move the bottom tool assembly and top tool assembly towards and away from each other resulting in engagement or disengagement of the camming structure with the tray side walls.

In the tray sealer the top tool assembly comprising a seal profile to engage the outwardly turned top margins of the tray side walls to form sealing flanges extending outwardly to form the side walls.

In the tray sealer the seal profile pressing the outwardly turned top margins of the tray side walls against the base tool assembly to form the sealing flanges.

In the tray sealer the seal profile pressing a sealing film against the tray for sealing the tray.

In the tray sealer the seal profile comprising a sealing surface to seal a film to the formed sealing flange of the tray.

In the tray sealer the top tool assembly further comprising a linkage assembly for sequencing the operation of the camming structure relative to the operation of the seal profile.

In the tray sealer the top tool assembly further comprising a film cutter cutting the file to correspond to the shape of the tray flange after the sealing film is sealed to the tray flange.

In another embodiment of the present disclosure, a method is provided for sealing a container having an open top defined by pliable, upwardly extending side walls. The method includes:

(a) pressing a camming surface against the top of the side walls to force the top margins of the side walls into an outwardly disposed position relative to the side walls;

(b) operating on the outwardly disposed side wall top margins to form a sealing flange; and (c) applying a top cover to the formed sealing flanges of the container.

The method also includes prior to pressing the camming surface against the side walls of the container, placing the container into a holder to secure the container in stationary position.

In the method, in placing the container in a holder, an abutment extends along and outwardly of the container to provide an abutment surface against which the top margin of the container side walls are pressed to form the sealing flange.

In the method, a plurality of camming surfaces are used to press against the top portion of the side walls to form the top margins of the side walls into an outwardly disposed position.

In the method, the camming surfaces are spaced apart from each other along the container side walls.

In the method, the camming surfaces are moved in unison.

In the method, the camming surface projects form a camming structure.

In the method, the camming structure is actuated to move in a linear direction as the camming surfaces press against the top portions of the container side walls.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
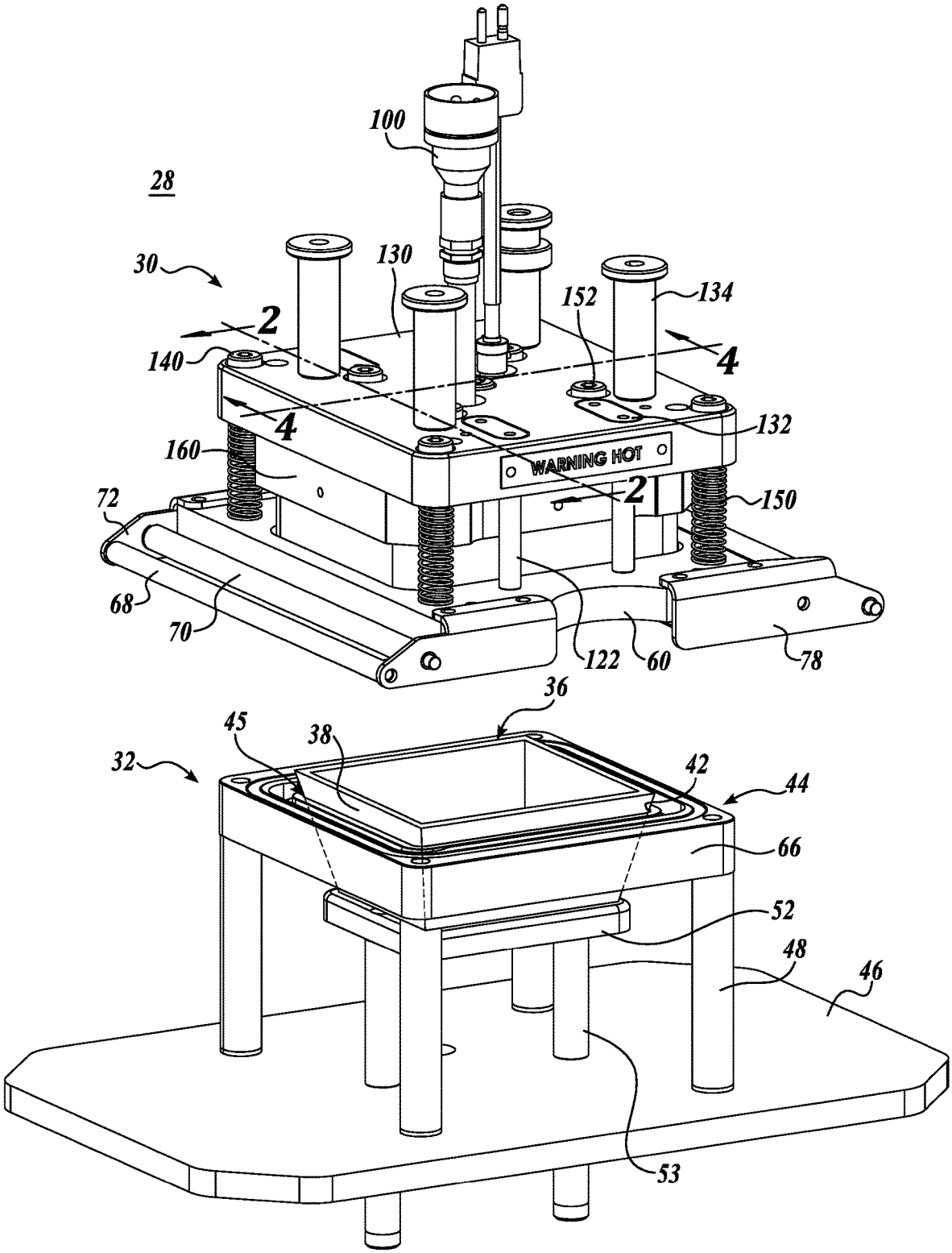
FIG. 1 is a pictorial view of the sealing apparatus of the present disclosure.

The description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to "directions," such as "forward," "rearward," "front," "back," "ahead," "behind," "upward," "downward," "above," "below," "top," "bottom," "right hand," "left hand," "in," "out," "extended," "advanced," "retracted," "proximal," and "distal." These references and other similar references in the present application are only to assist in helping describe and understand the present disclosure and are not intended to limit the present invention to these directions or specific references.

The present application may include modifiers such as the words "generally," "approximately," "about", or "substantially." These terms are meant to serve as modifiers to indicate that the "dimension," "shape," "temperature," "time," or other physical parameter in question need not be exact, but may vary as long as the function that is required to be performed can be carried out. For example, in the phrase "generally circular in shape," the shape need not be exactly circular as long as the required function of the structure in question can be carried out.

In the following description, various embodiments of the present disclosure are described. In the following description and in the accompanying drawings, the corresponding systems assemblies, apparatus and units may be identified by the same part number, but with an alpha suffix. The descriptions of the parts/components of such systems assemblies, apparatus, and units that are the same or similar are not repeated so as to avoid redundancy in the present application.

In the present application and claims, references to "tray," "carton," and "container," are used interchangeably and are meant to include all manner board, folded board or paper containers.

Figure 2:
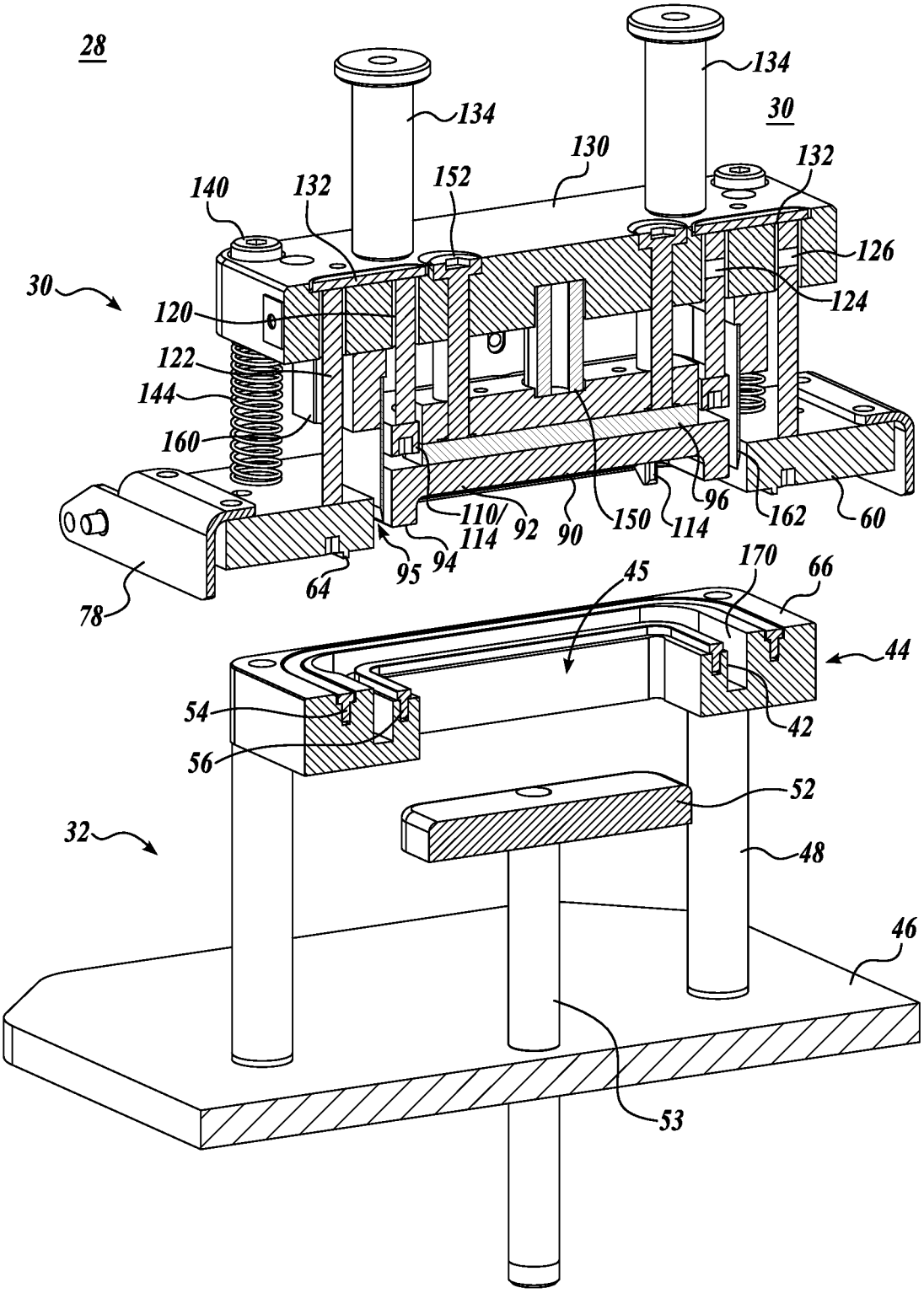
FIG. 2 is a cross-sectional view of FIG. 1, taken along lines 2-2 thereof.
Figure 3:
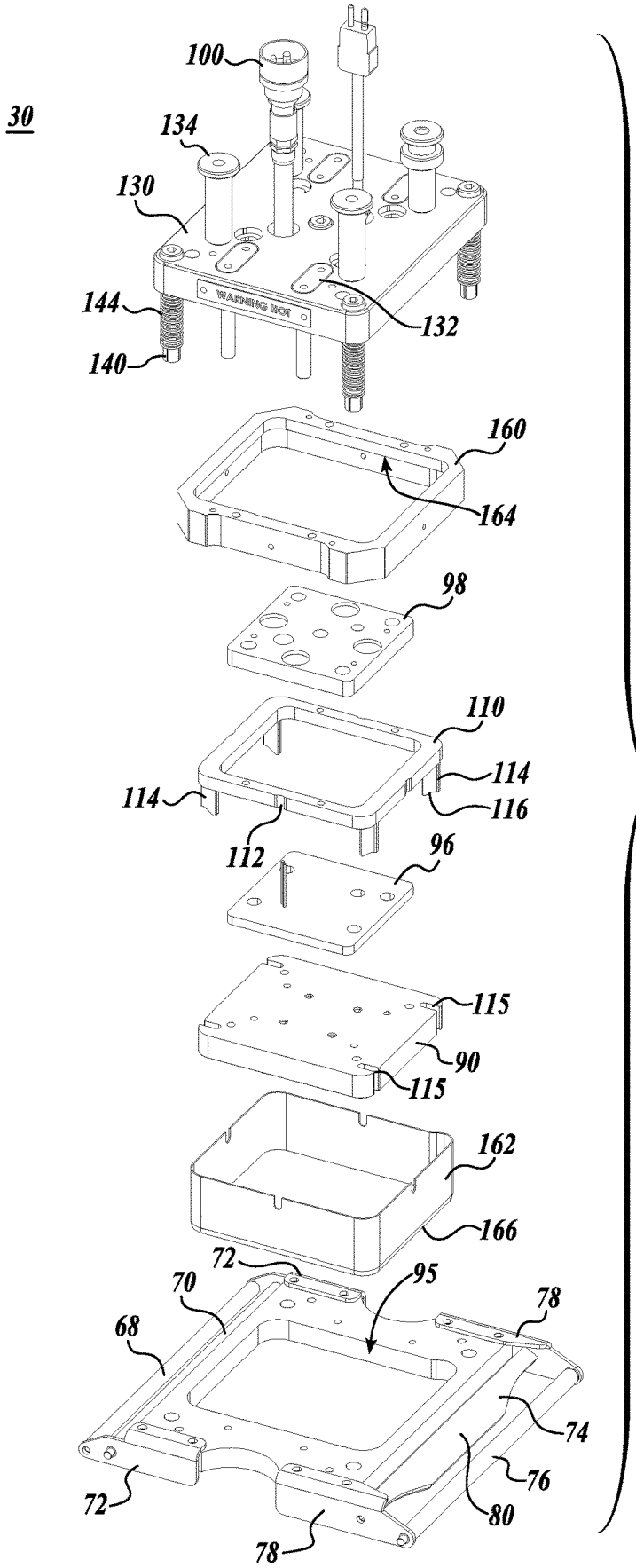
FIG. 3 is an exploded view of the top sealing tool of the apparatus of FIGS. 1 and 2.
Figure 4:
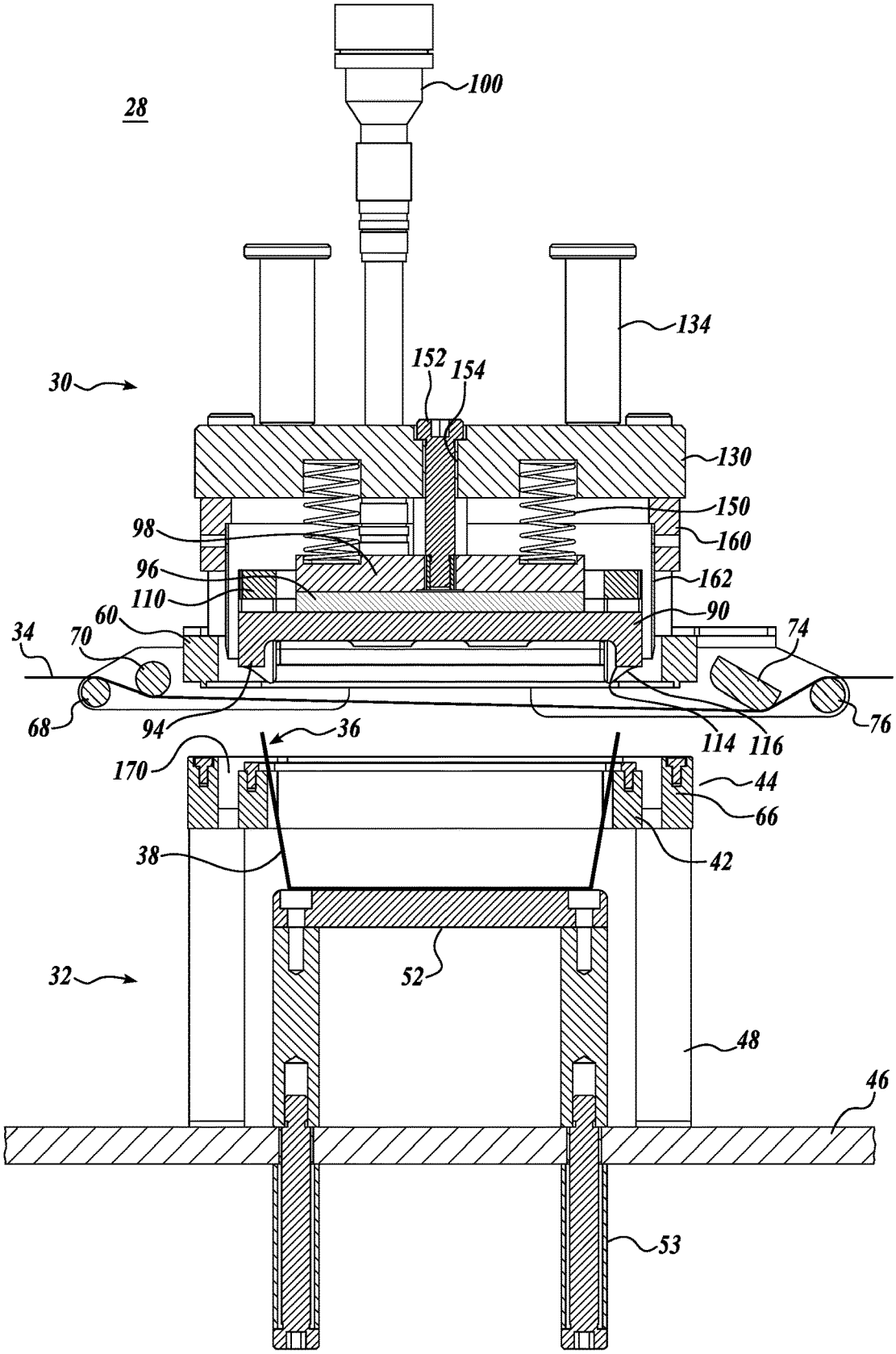
FIG. 4 is a cross-sectional view of FIG. 1 taken along lines 4-4 thereof.

The sealing apparatus 28 of the present disclosure includes in basic form a top tool assembly 30, see FIGS. 1-4, that cooperates with a bottom tool assembly 32, see FIGS. 1 and 4, to apply a plastic sealing film 34 to the open top of a carton or tray 36, or similar type of container.

The pliable side walls 38 of the carton/tray 36 to be sealed may close to vertical, as shown in FIG. 1. The sealing apparatus 28 of the present disclosure is capable of forming horizontal, outwardly directed sealing flanges 40 along the upper edge of the side walls 38. To this end, the carton/tray 36 is placed within the receiving bottom tool assembly 32. Thereafter, the top tool assembly 30 and bottom tool assembly 32 are pressed together to form the sealing flanges 40 and also to seal the top of the carton/tray 36 with the sealing film 34.

Referring specifically to FIGS. 1 and 4, the bottom tool assembly is constructed with a receiving structure 44, is spaced above a base 46 by a plurality of columns 48 projecting from the base at the corner portions of the receiving structure. The receiving structure 44 includes a central opening 45 having a shape corresponding to the shape of the upper portion of the carton/tray 36 so that the carton is received within the opening and the upper outer margins of the carton bear against the upper edges of the opening 45 when the carton rests on a central ejection pad 52, see FIG. 1.

The ejection pad 52 is supported by retractable and extendable columns 53 which are capable of retracting downwardly when the flanges 40 are formed in the carton 36, as described below. After flanges have been formed, columns 53 are capable of pushing the carton upwardly relative to the receiving structure 44 for removal of the formed carton from the bottom tool assembly 32.

The column structure 53 can be spring loaded, and/or pneumatically or otherwise actuated to place the carton 36 at the correct height relative to the bottom tool receiving structure 44 and to reduce in height during the forming of the carton flanges 40 and thereafter increase in height to eject the formed carton from the tool receiving structure 44.

The receiving structure 44 includes an inner rim 42 and an outer rim 66 that are spaced apart from each other by a clearance channel 170, the purpose of which is described below. The inner rim 42 forms a perimeter around the upper portion of the exterior of the carton sidewalls. The top of the inner rim 42 forms a ledge that extends around the carton side walls. This ledge functions as an abutment surface against which the top flanges 40 are formed by the apparatus 28.

A rubber or otherwise elastic insert 54 is engaged within a "T" channel formed in the top of outer rim 66. A corresponding rubber or other elastic insert 56 is disposed within a "T" shaped channel formed in the top portion of the inner rim 42. As shown in FIG. 1, when the carton 36 to be formed is placed in the bottom tool assembly 32 and supported by ejection pad 52, the upper margins of the side walls of the carton extend upwardly beyond the elevation of the top of inner rim 42 and the insert 56 disposed therein.

Referring initially to FIGS. 1-4, the top tool assembly 30 includes a planar film clamping plate 60 located at the base of the tool assembly. One purpose of the film clamping plate is to hold the film 34 against the bottom tool assembly 32 while the film is sealed to the carton flanges 40 and then while the film is cut to the shape defined by flanges. To this end, the film clamping plate 60 is designed to set against the bottom tool assembly 32 so that a ridge 64 that projects downwardly from the underside of the clamping plate aligns with a resilient insert 54 positioned into the upper surface of the receiving structure 44 thereby to securely hold the sealing film in place.

The sealing film is threaded or otherwise guided in place beneath the film clamping plate 60 by a pair of elongated infeed guide rollers 68 and 70 that are mounted in spaced parallel relationship to the adjacent edge of the clamping plate 60 by formed brackets 72. The brackets 72 include a top flange portion that is secured to the top surface of the margin of the clamping plate by appropriate hardware members. The sealing film is threaded to pass in the gap existing between the two guide rollers 68 and 70.

An outfeed guide assembly is mounted on the opposite side of the clamping plate 60, being composed of a generally flat guide blade 74 abutting the adjacent edge of the clamping plate and an elongated circular guide roller 76 spaced outwardly of the guide blade 74. As in the case of the infeed guide rollers 68 and 70, the outfeed guide blade 74 and roller 76 are mounted to the film clamping plate 60 by formed brackets 78. The brackets 78 include a top flange portion that overlaps the top marginal portion of the clamping plate. The brackets 78 likewise are secured to the film clamping plate 60 by hardware members extending downwardly through openings formed in the brackets 78 to engage within threaded openings formed in the clamping plate 60.

The guide blade 74 includes a wider central portion 80 that tapers to narrower end portions towards the opposite ends of the guide blade. The wider portion 80 is receivable within an opening formed in the roller of sealing film after being cut to sever the portion of the film sealed to the container. This helps keep the film centered on the rollers 68, 70 and 72. Of course, the guide rollers 68, 70 and 76 and the guide blades 74 can be mounted to the film clamping plate 60 by means other than brackets 72 and 78.

As shown in FIGS. 2-4, the top tool assembly 30 also includes a formed seal profile 90 consisting of a central portion 92 and an outer flange portion 94 extending around the central portion 92. The flange portion 94 coincides in size with the inner rim 42 of the receiving structure 44 of the bottom tool assembly, described above.

In one form of the present disclosure, the seal profile 90 is formed from metallic material so as to efficiently transfer heat to the portion of the sealing film 34 coinciding with the area of the flange portion 94.

Heat is applied to the seal profile 90 by a heating element plate 96 positioned against the upper surface of the central portion 92 of the seal profile. A heating element clamping plate 98 is used to clamp the heating element plate 96 between the clamping plate and the central portion 92 of the seal profile 90.

Electrical energy is routed to the heating element plate 96 by a cord assembly 100 that extends downwardly from an overhead electrical source.

Referring to FIGS. 2-4, a camming structure 110 in the form of a camming plate 112 having an open perimeter portion is positioned just outwardly of the heating element plate 96 and the heating element clamping plate 98 so as to closely encircle these components. The camming structure 110, as described below, is supported for vertical movement relative the bottom tool assembly 32, and in particular the receiving structure 44.

The camming structure 110 includes a plurality of wedge elements 114 that depend downwardly from the corners of the camming plate 112 to interact with the upper edge portions of carton 36. The wedge elements 114 slide through vertical slots 115 formed in the outer margins of the seal profile, so as to be in proper position relative to the carton 36.

The bottom ends of the wedge elements 114 taper inwardly in the downward direction (outwardly in the upward direction) so as to define angular or curved camming or forming surfaces 116. As the camming structure 110 is lowered relative to carton 36, the camming or forming surfaces 116 engage against the upper edges of the side walls 38 of the carton 36 and cause such upper edges to turn or fold outwardly relative to the carton. The camming surfaces are part of a linear cam structure in the sense that wedge elements 114 are moved in a linear direction to cause the camming surfaces 116 to operate against the upper edges of the carton side walls 38, which upper edges function as cam followers and deform outwardly under the linear movement of the wedge elements.

The downward travel of the camming structure 110 stops once the flanges 40 at the upper margins of the carton 36 are sufficiently turned outwardly so that such partially formed flanges are then contacted and further formed by the flange portions 94 of the seal profile 90. The flange portions 94 presses the carton flanges 40 downwardly against the top surface of the inner rim 42 of the receiving structure 44 to complete the forming of the flanges 40 and also to provide a surface for film 34 to seal against.

It will be appreciated that during the above-described downward travel of the camming structure 110, sealing film 34 is already in place over the top of the carton 36. However, the camming surfaces 116 do not puncture through the sealing film 34 since the wedge elements 114 stop their downward travel once the partially formed flanges are turned outward sufficiently that the flange portions 94 of the seal profile contact with the flange 40.

Although wedge elements 114 are illustrated in the drawings as located at or near the corners of camming plate structure 112, the wedge elements can be positioned at other locations with respect to the camming plate structure. Also, the number of wedge elements can be increased or decreased from that shown in the figures, for example, depending on whether the top margins of all of the sides of the container need to be formed into flanges. Also, the placement and number of the wedge elements may depend on the shape of the carton. The carton shown in the figures is square or rectangular in shape, but the carton can be formed in other shapes, such as circular, triangular, pentagonal, hexagonal, elliptical, oval, etc.

As noted above, the bottom camming surfaces 116 of the wedge elements 114 are tapered so as to cause the container wall upper edge portions to fold or turn outwardly as the camming structure is lowered relative to the carton 36. The camming surfaces of the wedge elements 114 can be in the form of a straight line or bevel, but can also be in other shapes, such as, for example, curved in an upwardly concave manner.

Next, referring to FIGS. 2 and 3, the camming structure 110 is interconnected to the film clamping plate 60 by a shorter connecting rod 120 extending upwardly from the camming structure 110 and a longer connecting rod 122 extending upwardly from the film clamping plate 60. Both of the connecting rods 120 and 122 pass through vertical clearance bores 124 and 126 formed in an overhead top pressure plate 130. The upper ends of the connecting rods 120 and 122 are interconnected by a lateral linkage plate 132 that is nominally disposed within a shallow depression formed in the upper surface of the top pressure plate 130.

As described below, the top pressure plate 130 overlies the structure of the top tool assembly and can be connected to an overhead vertical actuating system (not shown) by four tool mounting pillars 134 that are affixed to the pressure plate 130 by hardware members extending downwardly from the pillars to engage within threaded openings formed in the pressure plate 130. It is to be understood that rather than constructing apparatus 28 so that the top tool assembly 30 is powered or otherwise actuated to move towards and away from the bottom tool assembly 32, the sealing apparatus 28 can be designed and operated so that the bottom tool assembly 32 moves up and down relative to the top tool assembly 30, which remains stationary. Of course, if desired, both the top tool assembly and the bottom tool assembly can be constructed to move towards and away from each other, individually or simultaneously.

The pressure plate 130 is interconnected to film clamping plate 60 by a plurality of clamping screws 140 extending downwardly from at least each corner of the pressure plate 130 to engage with threaded openings formed in alignment in the film clamping plate 60. Compression springs 144 are engaged over the exterior of the clamping screws 140 to nominally maintain the pressure plate 130 at an elevation above the clamping plate 60. However, when the pressure plate 130 is moved further in the downward direction by a downward force imposed on the mounting pillars 134, the pressure plate 130 slides relative to the clamping screws 140 causing the springs 144 to depress. As described before, when the downward movement of the pressure plate 130 reaches a certain level, the pressure plate then also moves relative to the connecting rods 120 and 122.

The lowering of the pressure plate 130 also causes the downward movement of the camming structure 110. In this regard, when the pressure plate 130 is lowered, the pressure plate pushes against compression springs 144, which in turn push downwardly against the film clamping plate 60. In turn, the film clamping plate 60 pulls downwardly on connecting rod 122 as well as on connecting rod 120 which is attached to connecting rod 122 via overhead linkage plate 132. Since the camming structure 110 is attached to the lower end of the connecting rod 122, the camming structure is also pushed in a downward direction. However, once the bottom of the film clamping plate 60 presses against the top of the bottom tool receiving structure 44, the downward travel of the film clamping plate 60 stops, which also stops the downward travel of the camming structure 110. However, the downward travel of the seal profile, and associated heating plate 96 and clamping plate 98, can continue with the further downward travel of the overhead pressure plate, as described following.

The downward movement of the pressure plate 130 also causes the downward movement of the seal profile 90 as well as the heating plate 96 and clamping plate 98 located above the seal profile. Compression springs 150 are positioned between the top of the heating element clamping plate 98 and the underside of the top pressure plate 130. Thus, as pressure plate 130 lowers, a downward force is also applied to the seal profile 90. Subsequently, when the pressure plate 130 is raised upwardly to a retracted position, the compression springs 150 cause a separation between the pressure plate and the heating element clamping plate 98. This separation is limited by hardware members in the form of cap screws 152 that extend downwardly through clearance holes 154 formed in the pressure plate 130 to engage with threaded holes formed in the clamping plate 98.

Next, referring to FIGS. 2-4, the top tool assembly 30 also includes a blade carrier 160 which is in the form of a perimeter structure that is sized to surround the camming structure 110. The blade carrier 160 is attached to the underside of the top pressure plate 130 by hardware members extending between the top pressure plate 130 and the blade carrier 160. A thin rectangularly-shaped blade 162 is affixed to the inside vertical surfaces of the blade carrier 160 to extend downwardly from a shoulder 164, to extend below the lower surface of the blade carrier. The blade is sized and positioned to closely fit between the central opening 95 of the clamping plate 60 and the exterior of the seal profile 90. Since the blade carrier 160 is affixed to the top pressure plate 130, as the top pressure plate raises and lowers, the blade 162 also raises and lowers to the same extent as the pressure plate.

The purpose of the blade 162 is to cut the sealing film 34 after the sealing film has been fused to the container flanges 40 from the heat and pressure applied by the sealing profile 90. To this end, the blade 162 is formed with a sharp bottom edge 166. A narrow upwardly open channel 170, described above, is provided between the outer rim 66 and an inner rim 42 of the receiving structure 44 for receiving the bottom edge 166 of the blade 162.

Next, describing the operation of the sealing apparatus 28, referring especially to FIGS. 4 and 5A-5E, with the carton/tray 36 placed in the bottom tool assembly 32, the upper edge of the carton extends above the upper surface of the receiving structure 44. At this point, the bottom of the carton rests on the ejection pad 52.

From the starting position of FIG. 4, the top pressure plate 130 is driven downwardly by the mounting pillars 134 thereby compressing the springs 144 acting between the pressure plate 130 and the clamping plate 60. Simultaneously, the camming structure 110 is lowered so that eventually the camming edges 116 at the bottom of the wedge elements 114 bear against the upper edge of the carton side walls 38, see FIG. 5E. The cutting blade 162 is also simultaneously being lowered due to the lowering of the blade carrier 160 with the top pressure plate 130.

As the top pressure plate 130 continues to lower, the wedge elements 114 also continue to lower thereby forcing the upper edges of the carton side walls to turn further outwardly. The downward travel of the camming structure 110 stops when the bottom of clamping plate 60 bears against the top of the outer rim 66 of the bottom tool receiving structure 44, see FIG. 5B. At this point, the camming surfaces 116 of wedge elements 114 are disposed above the elevation of the carton flange 40 when fully formed.

Figure 5A:
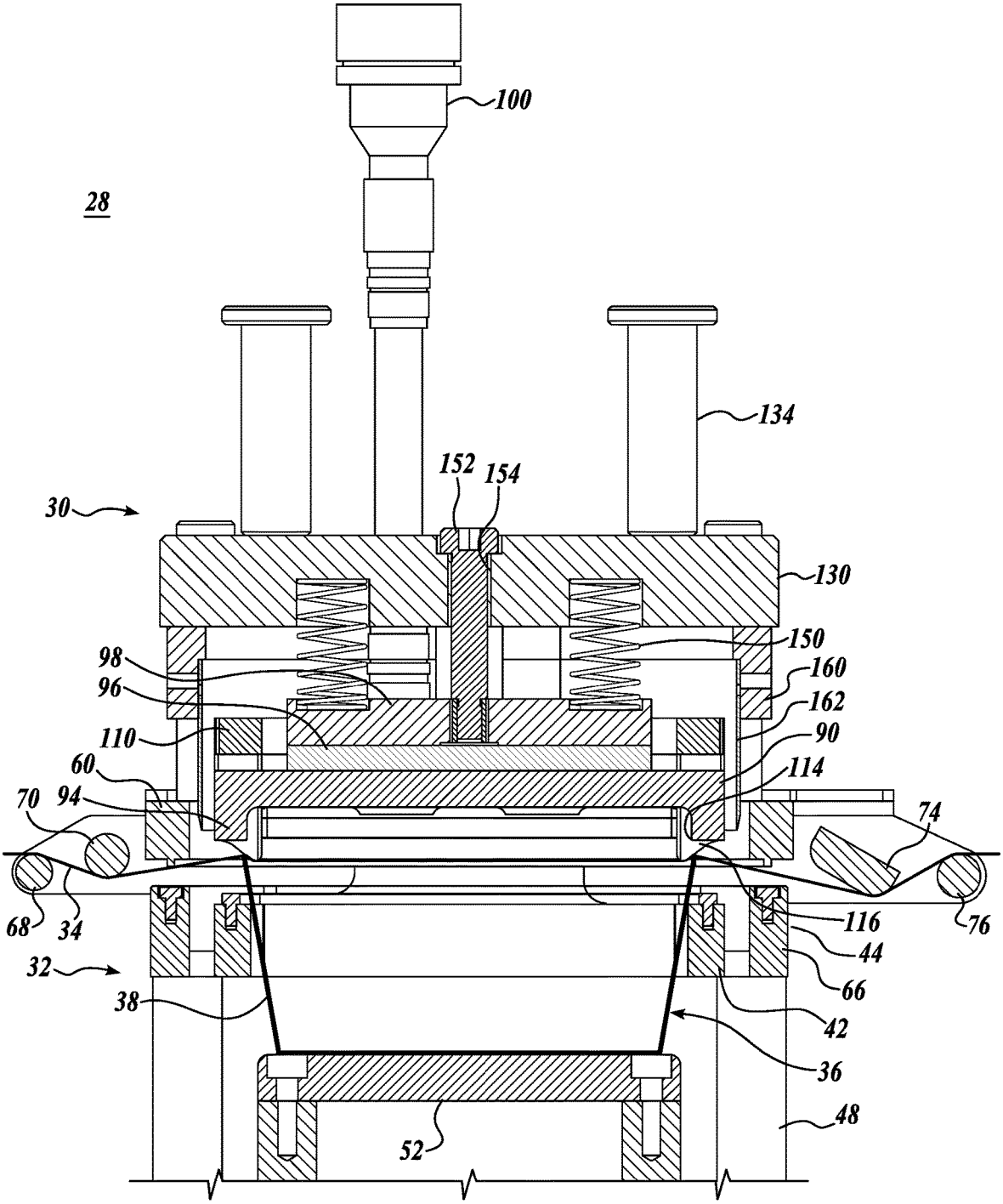
FIGS. 5A-5E illustrate the progression of the top tool and bottom tool relative to each other as the sealing apparatus is used to seal a top film on a container.
Figure 5B:
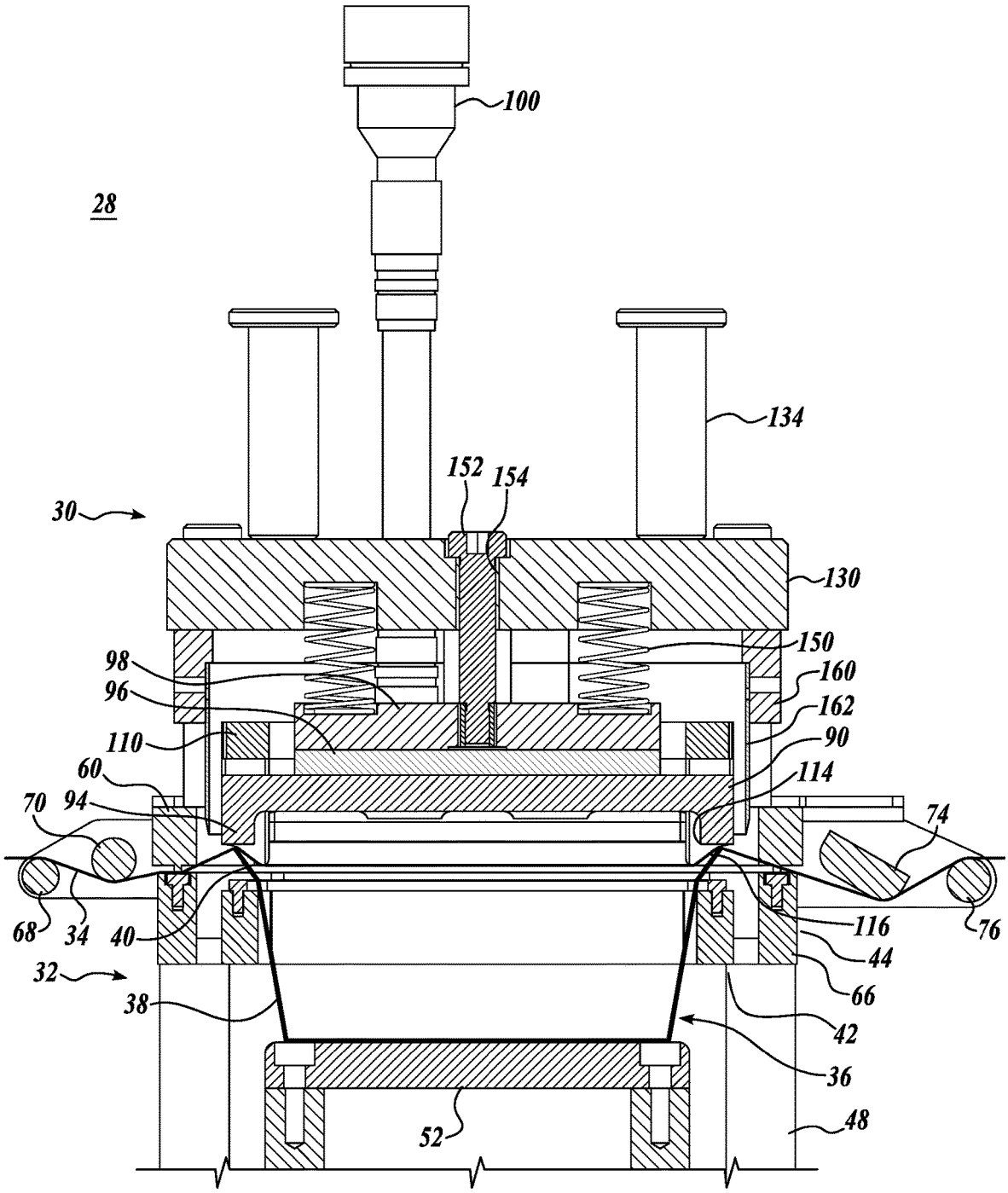
Figure 5C:
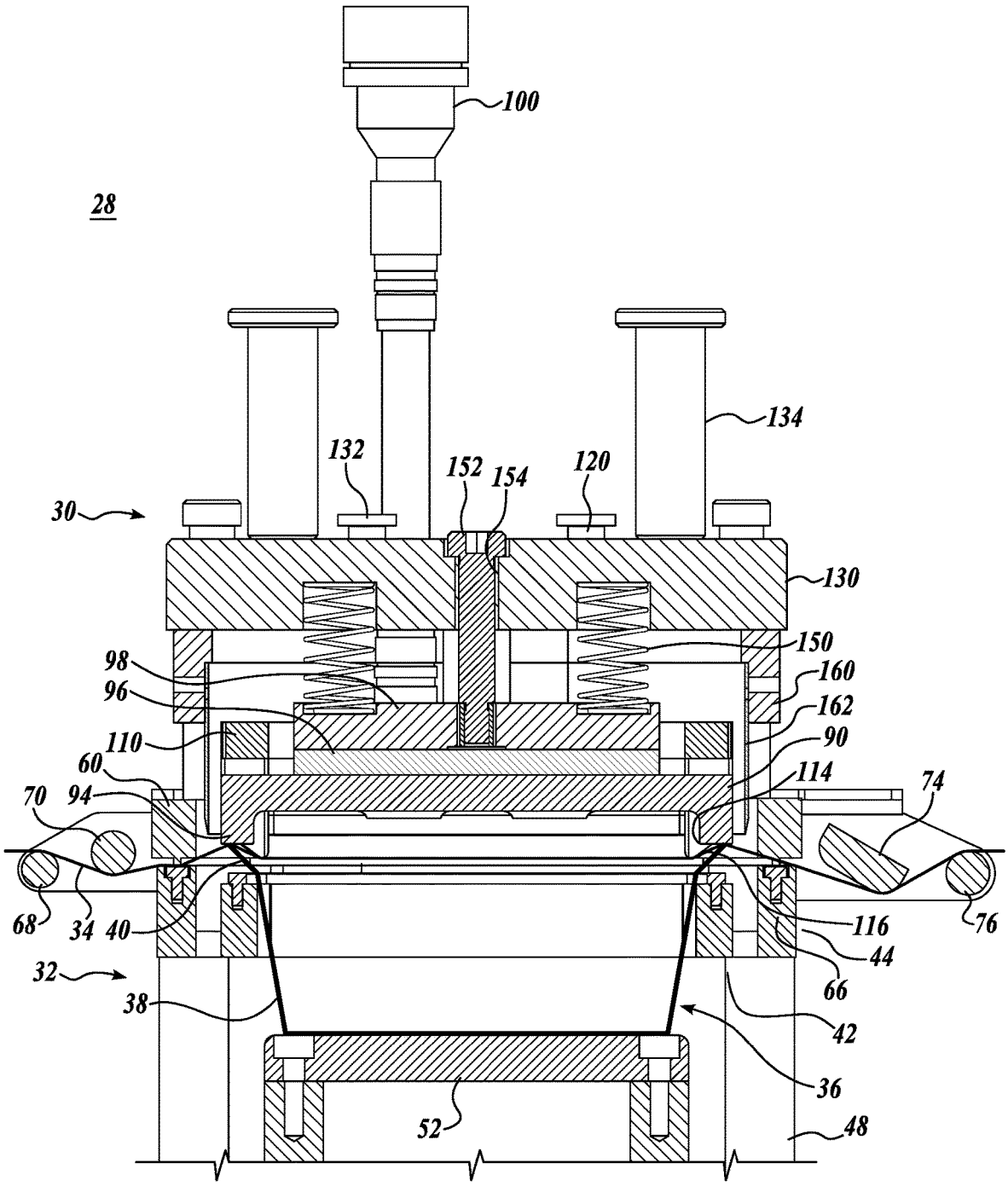
Figure 5D:
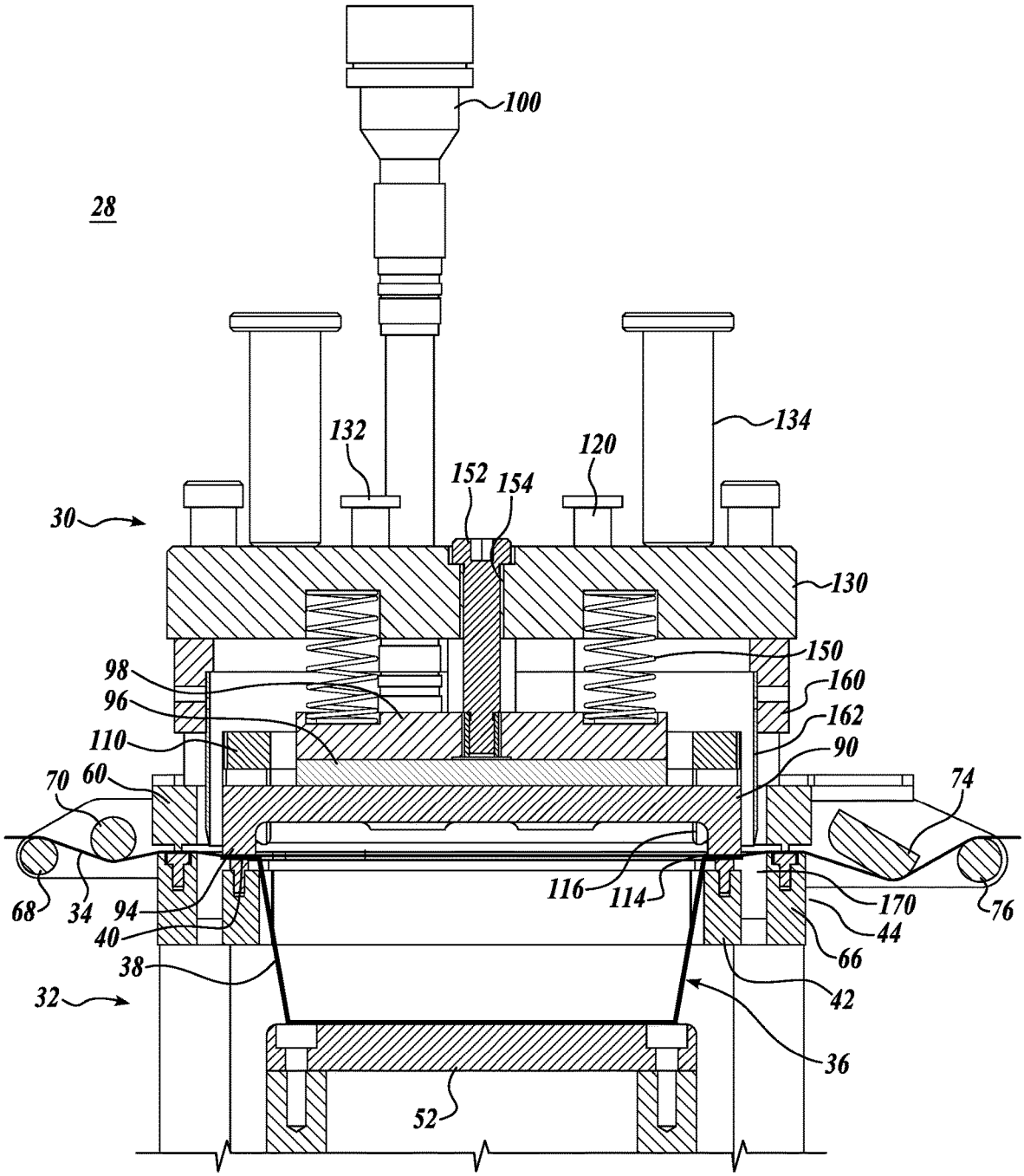
Figure 5E:
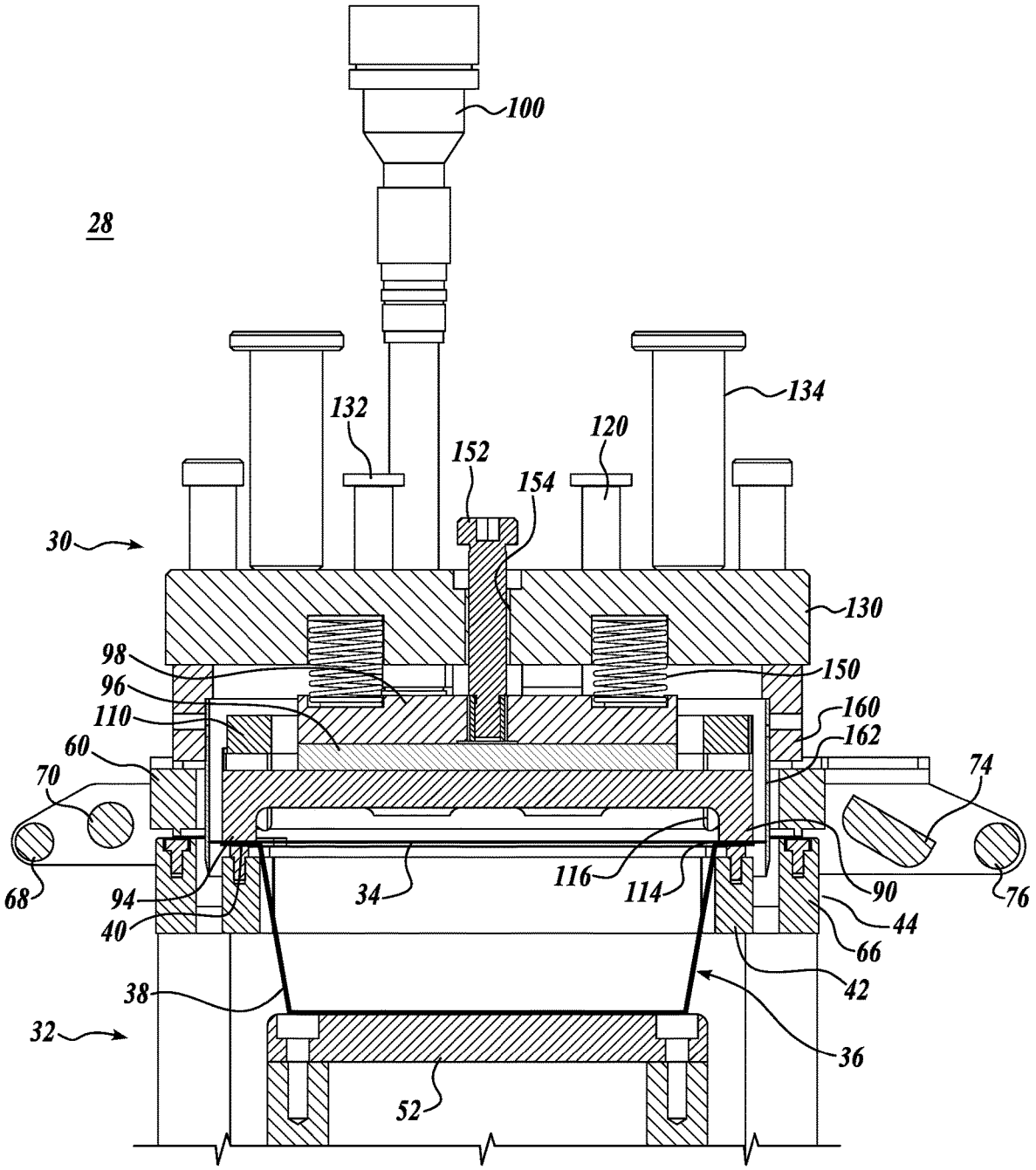

As the top pressure plate 130 continues to lower, the carton flange 40 is further formed into a horizontal orientation by the flange portions 94 of the seal profile 90, see FIGS. 5C and 5D. When the seal profile flange portions 94 bear against the inner rim 42 of the receiving structure 44, the downward travel of the seal profile 90 stops. However, the top pressure plate 130 does continue to move downwardly until the blade 162 cuts through the sealing film 34. As this occurs, the blade lowers into the channel 170 located between the inner rim 42 and the outer rim 66, see FIG. 5E. Simultaneously, springs 150 compress to enable the top pressure plate 130 to continue to lower relative the seal profile 90 towards the bottom tool assembly 30.

It will be noted that when the top pressure plate 130 is in this fully downward position, the top pressure plate has lowered relative to the height of the connecting rods 120 and 122 since the downward travel (toward the bottom tool assembly 32) of the clamping plate 60 and camming structure 110 had since ceased.

During the contact between the flange portions 94 of the seal profile 90 and the inner rim 42, the heat from the seal profile creates a seal between the film 34 and the formed container flanges 40. Once the seal has been formed and the sealing film 32 is cut by blade 62, the downward load on the mounting pillars 134 is removed, which enables the compression springs 150 to expand or extend thereby separating the distance between the underside of the top pressure plate 130 and the heating element clamping plate 98 until the top of cap screws 152 bottoms against the counter bore formed in the top of pressure plate 130 thereby raising the seal profile 90 and associated heating plate 96 and clamping plate 98 upwardly.

Simultaneously with the expansion of springs 150, the compression spring 144 expand to increase the distance between the top pressure plate 130 and the film clamping plate 60. Once a sufficient separation has been achieved between the top pressure plate 130 and the film clamping plate 60, the top pressure plate pushes upwardly against the lateral linkage plate 132 between the connecting rods 120 and 122 thereby retracting the camming structure 110 in the upward direction.

The upward movement of the top tool assembly results in a corresponding upward movement of the blade carrier 160, and eventually the retraction of the cutting blade 162 to the fully retracted position shown in FIG. 4.

Once the top tool assembly 30 has been sufficiently retracted upwardly, the sealing film 34 is advanced so as to place a new section of the film beneath the film clamping plate 60 thereby to be ready for the next cycle of the sealing apparatus 28.

While illustrative embodiments have been illustrated and described, it will be appreciated that various changes can be made therein without departing from the spirit and scope of the invention. For example, as briefly noted above, rather than operating the sealing apparatus 28 to lower and raise the top tool assembly 30, instead the bottom tool assembly 32 can be raised and lowered relative to the top tool assembly. Further, both the top and bottom tool assemblies can be constructed to move towards and away from each other. If the sealing apparatus 28 is constructed so that the bottom tool assembly 32 moves relative to the top tool assembly 30, the sequence of operation of the top tool assembly 30 as described above can remain the same.

Also, a singular top tool assembly 30 and bottom tool assembly 32 are illustrated. However, it will be understood that sealing machinery can be constructed with multiple top tool assemblies and bottom tool assemblies as singular tool sets so as to seal a plurality of cartons 36 at the same time. The singular tool sets can be actuated with a single top and/or bottom actuator.

Further, cartons may be provided wherein in two side walls (typically opposing), the top marginal portions may already be flared outwardly so as not to require further action by the camming structure. Rather, the camming structure can be adapted to focus on the other two opposed side walls in which the upper portions extend substantially vertically upward. As such, the positions of the wedge elements 114 can be modified to adapt to the particular carton side walls, which require their upper rim portions to be forced in the outward direction by the wedge elements 114. For a carton with four sidewalls, the camming structure can operate on from one to four of the sidewalls. For cartons with a different number of sidewalls, the camming structure can operate on from 1 to all of the sidewall of the carton.

Further, although one example of the actuation of a camming structure has been illustrated and described, it is to be understood that the camming structure 110 can be actuated by other means, for example, by one or more linear actuators or servo motors, whether pneumatically, hydraulically or electrically powered. Such actuators/motors can be operationally connected to the connecting rods 120 to directly actuate the camming structure 110. Further, rather than utilizing a camming structure 110, the wedge elements 114 can be connected to the lower end of a connecting rod, such as connecting rod 120, with the upper ends of such connecting rods attached to an actuator or servo motor. Alternatively, the upper ends of such connecting rods can be attached to a perimeter structure such as perimeter structure 112 located above the top tool assembly 30 and such perimeter structure raised and lowered by one or more actuators or by a servo motor.

The embodiments of the invention in which an exclusive property or privilege is claimed are defined as follows:

1. A top tool assembly for assisting in forming flanges along the top of the pliable side walls of a carton, comprising:

(a) a plurality of planar camming surfaces configured to engage a top portion of pliable side walls of a carton, the side walls being in nominal upright orientation relative to the interior of the carton;

(b) a camming structure to which the camming surfaces are mounted, the camming structure is movable toward the carton to force the camming surfaces against the top portion of the side walls of the carton in an outward direction relative to the interior of the carton to partially deform the top portion of the pliable side walls further outwardly relative to the nominal orientation of the side walls relative to the interior of the carton; and (c) a seal profile having a flat perimeter portion corresponding to the locations of the camming surfaces, the seal profile moveable relative to the camming surfaces to present the perimeter portion against the top portion of the sidewalls to deform the top portion of the pliable side walls further outwardly relative to the initial deformation of the top portion of the side walls by the camming surfaces to form sealing flanges along the top of the carton side walls.

2. The top tool assembly according to claim 1, wherein: the carton having a bottom; and the camming structure is moveable to move the camming surfaces towards the bottom of the carton to bear against the top portion of the side walls of the carton.

3. The top tool assembly according to claim 1, wherein the camming surfaces are contoured to extend upwardly and outwardly relative to upper edge portions of the carton side walls thereby to deform the upper edge portions outwardly as the camming surfaces are moved toward the bottom of the carton.

4. The top tool assembly according to claim 1, wherein the camming surfaces are part of a linear cam.

5. The top tool assembly according to claim 1, further comprising a holder for receiving the carton therein, the holder comprising a perimeter extending along the upper portion of the carton.

6. The top tool assembly of claim 1, wherein the seal profile further deforming the top portion of the pliable side walls of the carton to cause the top portion of the pliable side walls to extend around the carton in a horizontal plane.

7. The top tool assembly of claim 1, further comprising a stop to prevent the further travel of the camming surfaces toward the carton once the top portion of the pliable side walls have been partially deformed outwardly by the camming surfaces while allowing the seal profile to continue moving toward the carton.

8. A tray sealer, comprising:

(a) a bottom tool assembly for receiving trays to be sealed, the trays having upwardly extending, pliable and deformable side walls disposed in nominal upright orientation with top margins;

(b) a top tool assembly, comprising a camming structure for deforming the top margins of the tray side walls outwardly relative to the trays to initiate the formation of a sealing flange, the camming structure having a plurality of planar camming surfaces; and (c) the camming structure moveable relative to a base tool assembly to press the camming surfaces against the top margins of the tray side walls to partially deform the top margins of the side walls outwardly relative to the nominal upright orientation of the side walls; and (d) a seal profile moveable relative to the camming structure and having a flat perimeter portion to engage the top margins of the tray side walls previously partially outwardly deformed by the camming surfaces to deform the top margins of the tray side walls further outwardly relative to the orientation of the top portion of the side wall resulting from the initial deformation of the top portion of the side walls by the camming surfaces to form sealing flanges extending outwardly to form the side walls into a flat top plane.

9. The tray sealer according to claim 8, wherein the camming structure comprises a plurality of camming surfaces contoured to press in unison against the top margins of the tray side walls as the camming structure moves toward the base tool assembly.

10. The tray sealer according to claim 9, wherein the camming structure comprises a camming plate and wherein the camming surfaces projecting from the camming plate.

11. The tray sealer according to claim 10, wherein the camming plate is in the form of a perimeter structure having an open central portion to provide clearance for portions of the top tool assembly.

12. The tray sealer according to claim 11, wherein the camming surfaces project from the perimeter structure.

13. The tray sealer according to claim 10, wherein the camming surfaces are disposed at the distal ends of wedge elements that project from the camming plate.

14. The tray sealer according to claim 8, wherein the camming surfaces project outwardly relative to the tray in the direction along the tray side walls from the bottom of the tray to the top of the tray.

15. The tray sealer according to claim 8, wherein the bottom tool assembly and top tool assembly are moveable towards and away from each other resulting in engagement or disengagement of the camming structure with the tray side walls.

16. The tray sealer according to claim 8, wherein the top seal profile is movable relative to the camming surfaces.

17. The tray sealer according to claim 16, wherein the top tool assembly further comprising a linkage assembly for sequencing the operation of the camming structure relative to the operation of the seal profile.

18. The tray sealer according to claim 8, wherein the seal profile pressing the outwardly turned top margins of the tray side walls against the base tool assembly to form the sealing flanges.

19. A method for sealing a container having an open top defined by pliable, deformable nominally upwardly extending side walls, comprising:

(a) initially pressing a planar camming surface against the top of the side walls to partially deform the top margins of the side walls into an outwardly disposed initial position relative to the nominally upward orientation of the side walls;

(b) thereafter operating on the outwardly disposed side wall top margins with a seal profile that is movable relative to the camming surface and having a flat perimeter portion to press against and to further deform the side wall top margins further outwardly relative to the orientation of the side wall top margins resulting from the deformation of the side wall top margins by the camming surfaces thereby to form a horizontal sealing flange; and (c) applying a top cover to the formed sealing flanges of the container.

20. A method according to claim 19, wherein a plurality of camming surfaces are used to press against the top portion of the side walls to form the top margins of the side walls into an outwardly disposed position relative to the nominal upright position of the sealing container side walls.

* * * * *